United States Patent [19]

Cohen-Alloro et al.

[11] 4,078,996

[45] Mar. 14, 1978

[54] VIBRATING TABLE FOR THE GRAVIMETRIC SEPARATION OF FINE PARTICLES

[75] Inventors: Richard Cohen-Alloro, Olivet; Roger Omer Cuvillier, Jargeau, both of France

[73] Assignee: Bureau de Recherches Geologiques et Minieres, Paris Cedex, France

[21] Appl. No.: 696,331

[22] Filed: Jun. 15, 1976

[30] Foreign Application Priority Data

Jun. 18, 1975 France ..... 75 19131

[51] Int. Cl.[2] ..... B03B 5/04

[52] U.S. Cl. ..... 209/441; 209/366.5; 209/504; 209/508

[58] Field of Search ..... 209/366.5, 367, 441, 209/437, 442, 443, 472, 480, 504, 506, 508; 74/61, 87

[56] References Cited

U.S. PATENT DOCUMENTS

| | | | |
|---|---|---|---|
| 315,824 | 4/1885 | Patten | 209/508 X |
| 657,393 | 9/1900 | Buss | 209/508 X |
| 660,342 | 10/1900 | Smith | 209/441 |
| 1,388,097 | 8/1921 | Capsoni | 209/367 X |
| 1,428,392 | 9/1922 | Ogden | 209/44 |
| 2,084,976 | 6/1937 | Puerner | 209/504 X |
| 2,907,459 | 10/1959 | Jean | 209/441 X |
| 3,075,644 | 1/1963 | Ambrose | 209/441 X |
| 3,863,766 | 2/1975 | Oetiker | 209/504 X |

FOREIGN PATENT DOCUMENTS

| | | | |
|---|---|---|---|
| 712,148 | 7/1954 | United Kingdom | 209/481 |

*Primary Examiner*—Frank W. Lutter
*Assistant Examiner*—Ralph J. Hill
*Attorney, Agent, or Firm*—Sughrue, Rothwell, Mion, Zinn and Macpeak

[57] ABSTRACT

The invention relates to a vibrating table allowing very fine particles to be separated with output rates greater than for known tables.

The table, supplied with pulp has a series of longitudinal grooves having a decreasing depth. The table mounted with the aid of spring blades on a chassis having an adjustable inclination by means of screws. The positions of the weights of a box are controlled by the group motor having a variable speed, are angularly and radially adjustable. The adjusting of the frequency during the operation allows a maximum output.

The invention is applicable to the gravimetric separation of all particles.

5 Claims, 14 Drawing Figures

VIBRATING TABLE FOR THE GRAVIMETRIC SEPARATION OF FINE PARTICLES

The present invention, relates to a vibrating table for the gravimetric separation in a wet medium of particles in suspension in a pulp, as well as to the method of vibrating for putting it into operation.

In known gravimetric tables for separating light particles from dense particles in a granular medium, the device generally comprise a platform which is slightly inclined relative to the horizontal. This platform can be fixed, for tables known, treating more particularly pulps of fine particles, remain deficient as a result of their insufficient output rate, the poor degree of purity of the heavy products separated, and the very low rate of recovery of these products.

In the tables with a moving platform, more currently used and known under the name of shaking tables, the top which is generally rectangular is provided with hollow or projecting channels to provide grooves or ribs. The movement of the top is obtained by a mechanism which imparts asymmetric and longitudinal shocks to it. This apparatus is capable of absorbing a high feed rate and of providing heavy concentrates of a high grade, often with a satisfactory recovery rate. Nevertheless, the field of application of these shaking tables only extends to relatively large particles to the exclusion of very fine grains, for example having a size less than 50 microns. There exist, therefore, in certain industries and notably in the mining industry, particular difficulties of separation by gravity of particles of a few microns and a few tens of microns.

It has been suggested that, in order to treat particles less than 250 microns, a table to which vibrations produced by unbalanced boxes is utilized, but this apparatus has not been developed by virtue of the low output rate compared to output rates of conventional shaking tables using rods and eccentric cams, those output rates being of the order of 10 to 20 times less than the output rates of shaking tables.

The principle object of the present invention is a vibrating table for the gravimetric separation of fine particles in suspension in water or in another liquid, comprising an unbalanced box and a top with an adjustable inclination, characterised in that the top is lined with projecting ribs and/or hollow grooves of which the thickness and/or depth decrease in the longitudinal direction of the table.

Experience has shown then that it becomes always possible to carry out gravimetric separation on grains less than 50 microns, by adjusting the components of movements of the table and the flow-rates of pulp and additional water for sprinkling.

Thus, another object of the invention is a table of the type defined above, comprising means for continuously adjusting the amplitude and adjusting the frequency governing the movement of the top of the table.

As opposed to known tables, it becomes possible to carry out separation on fine particles without harmfully perturbing the density separation, even when a flow rate comparable with that of the biggest particles occurs. It was possible, with known tables, to select low frequencies, for example less than 5 cycles, and relatively large amplitudes of movement, 3 to 30 mm, for example, but then suitable separations could not be obtained. Conversely, a low amplitude, less than 1 mm, and a frequency of several tens of Hertz, not only reduced the output rate, but favoured the piling up of grains, equally prejudicial to the differential separation. The combination of grooves of decreasing depth and means for continuously adjusting the movement allows such a piling up to be avoided while increasing the output rate.

Another object of the invention is a convenient means for adjusting the parameters of movement imparted to the vibrating table characterised in that the unbalanced vibrator is composed of four independent masses arranged in two tiers, the positions of these masses being adjustable both radially and angularly in relation to each other.

One can in this way very easily and by simple observation of the behaviour of the pulp determine the law of movement most appropriate to the new mixture to be treated, the movement no longer being rectilinear.

Another object of the invention is a vibrating table of this type, characterised in that the frequency is made continuously adjustable during operation of the table by coupling a speed controller on the drive shaft of the unbalanced box.

The frequency can be continuously adjusted over a wide range and the optimum frequency determined by observing how the particles to be separated react on the table and by choosing the most appropriate separation speed.

Another object of the invention as a table of the preceding type, characterised in that it comprises a return means ensuring the rapid return of the table. This is formed by a series of spring blades inclined relative to the vertical and supporting the top by linking it in a quasi-elastic manner to a chassis having a large mass.

One therefore possesses a convenient system which, in combination with the unbalanced box, allows one to act on the direction and trajectory of the particles by varying the inclination and the angle of attack of the plane of the table relative to the spring blades.

Another object of the invention is to ensure that control during the operation of the table of the output rates of the heavy and light particles by means of adjusting the longitudinal and transverse slopes of the table.

This arrangement is particularly interesting, because it avoids an untimely overflowing of the light particles and a prejudicial feeding of the heavy particles into the zone of the light particles, the movement of the top always being controlled.

Another object of the invention is a table of this type for which the output from a given surface of the table is increased by a group of arrangements of grooves in independent zones, so that each zone receives an optimum output rate corresponding to the best degree of separation via an appropriate feed ramp, the sum of the ouput rates from the different zones at the same time increasing the output and the work quality per square metre.

Other advantages and characteristics will appear from the following description made by reference to the attached drawings which represent, by non limiting example, one embodiment of the invention and one of the possible varients.

Figure 1:
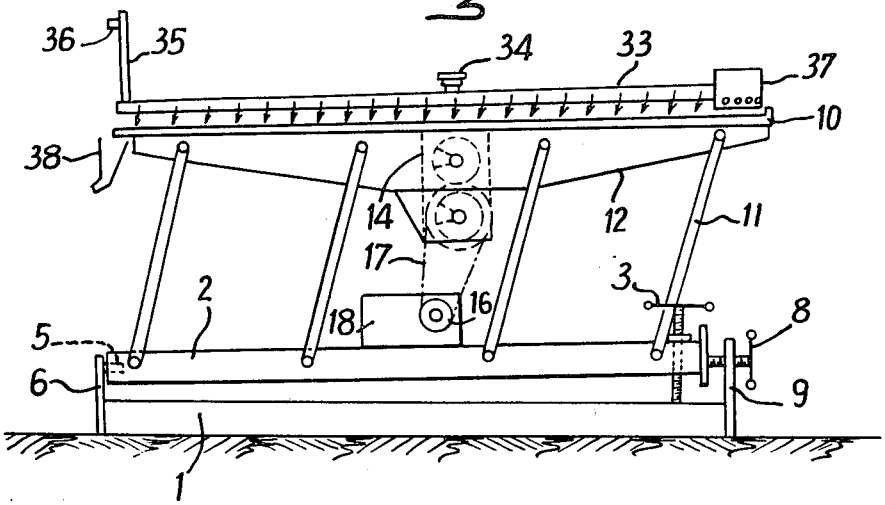
FIG. 1 is a diagrammatic view in elevation of the vibrating table.
Figure 2:
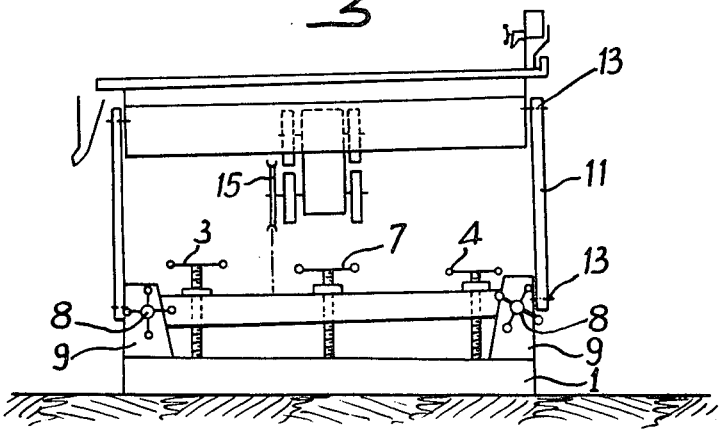
FIG. 2 is a diagrammatic view of the profile of the table shown in FIG. 1.

In the embodiment shown in FIG. 1, the fixed chassis of the table has been referenced 1. This chassis serves as a support for the very heavy chassis 2 whose position can be adjusted and whose inclination can be adjusted according to the desired direction during the operation of the table by means of adjusting screws 3 and 4, shown in FIG. 2, the inclined chassis 2 resting at an articulation point 5 on the fixed support 6 of the chassis 1. The screw 7 situated between the adjusting screws 3 and 4, serve as a support during the adjusting of the inclination. After adjustment, the inclination is retained by means of blocking screws 8 mounted on the supports 9 of the chassis 1.

Figure 13:
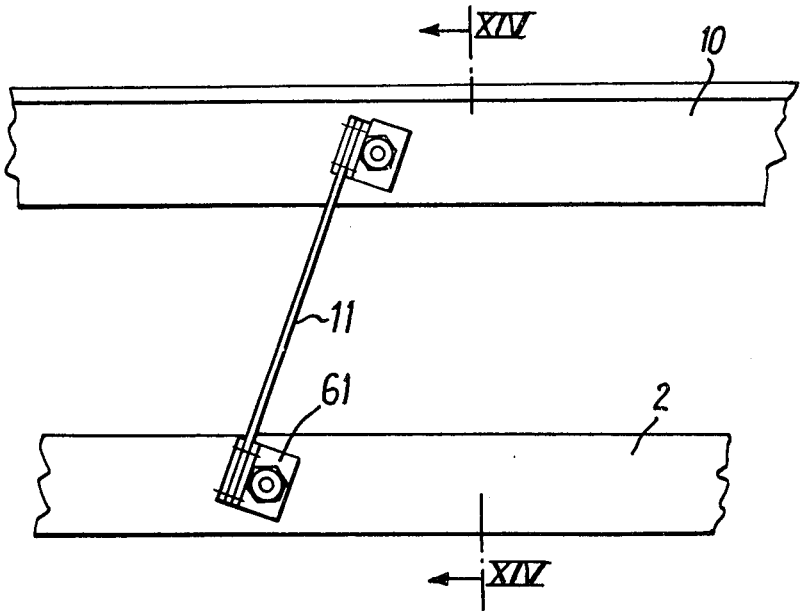
FIG. 13 is a partial view of a link for the chassis and top.
Figure 14:
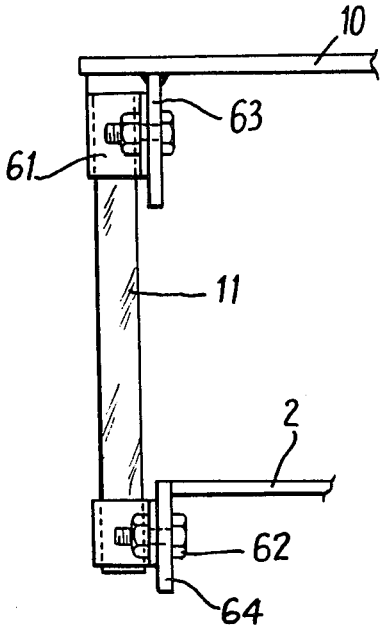
FIG. 14 is a section along the line XIV—XIV of FIG. 13.

The inclinable chassis 2 supports the top 10 by means of spring blades 11 whose ends can be fixed to the longitudinal edges of the chassis 2 and of the side members 12 fixed to the member 10. The fixing means 13 can be arbitrary, the locking being ensured by a screw and keyed nut or any other conventional fixing device allowing the adjustment of the inclination of the blades 11. Blades 11 can have a thickness, as in the case of the FIG. 9, or can be thin as shown in FIGS. 13 and 14, to require right-angled support 61 that can be fixed by bolts 62 to the parts 63 and 64 of the top 10 into the chassis 12. The top 10 is integral with the unbalanced box 14 which is driven by means of the pulleys 15 and 16 and the transmission belt 17, the pulley 16 being driven by the motor block 18 mounted on the chassis 2. The drive speed is controlled in a continuous manner and it can be seen that the frequency of movement of the top 10 caused by the unbalanced box 14 can varied in a continuous manner, this variation being extendable from a few to several tens of cycles per second.

Figure 10:
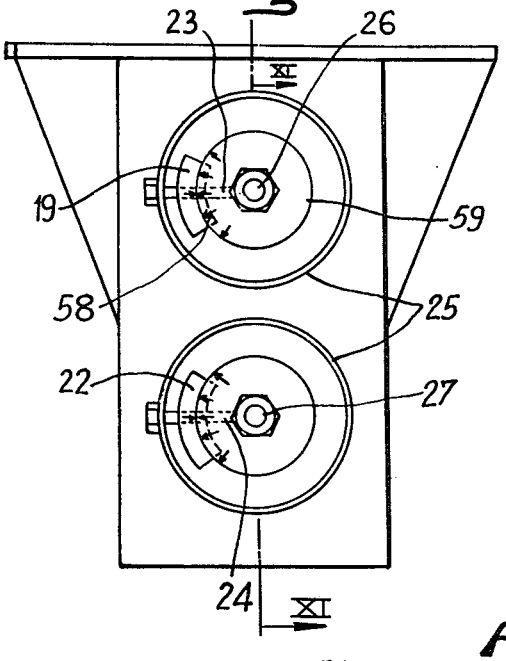
FIG. 10 is a diagrammatic view in elevation of the unbalanced box.
Figure 11:
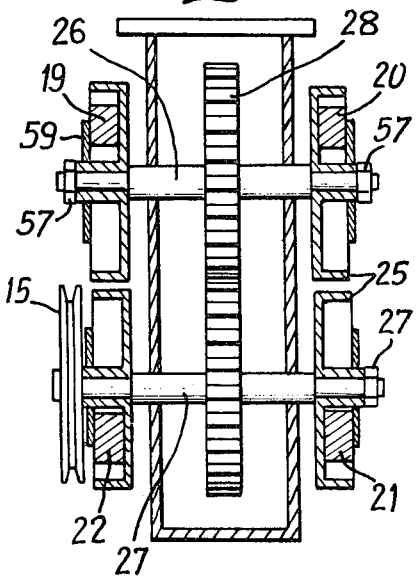
FIG. 11 is a cross-section along the line XI—XI of FIG. 10.
Figure 12:
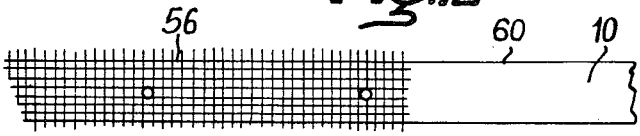
FIG. 12 is a partial diagrammatic view of the edge of a top provided with means for regulating the discharge.

Weights 19 to 22, FIGS. 10 and 11, slide radially along adjusting screws 23 and 24 mounted on the casing 25 driven by shafts 26 and 27 integral with drive pinions 28. The pulley 15, keyed to the shaft 27, thus drives the assembly of the weights at the selected speed. In order to readily adjust the angular separation between the weights, screws 57 are unscrewed to the end of the shaft 26 and the casings are shifted to the desired angle, this angle being rotatable by index 58 on the keyed top 59 at the ends of shaft 26. It is this shift which conditions the angle between the direction of maximum effort of the weights and the blades 11.

Figure 3:
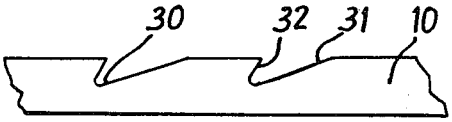
FIG. 3 is a view in partial cross-section of one type of grooves of the table proper.
Figure 4:
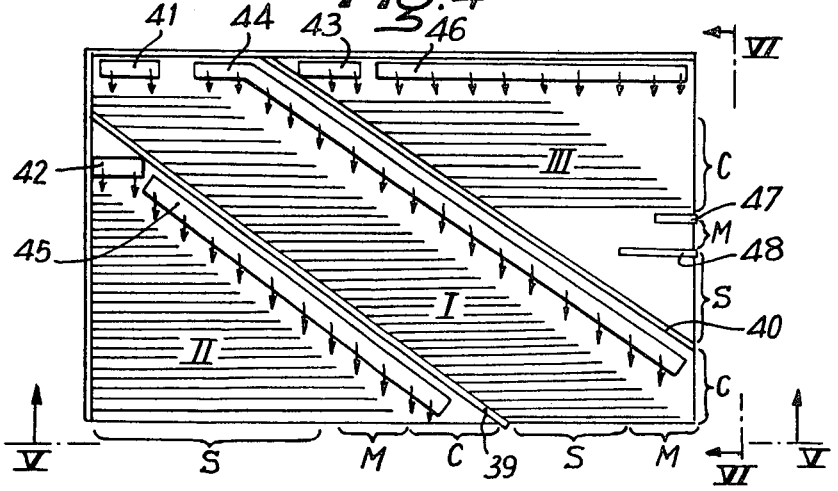
FIG. 4 is a plan view of the top of the table.
Figure 5:
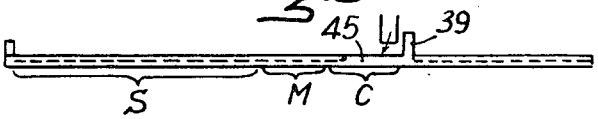
FIG. 5 is a view of the longitudinal side of the top of FIG. 4.

Although the top 10 can carry conventional grooves or ribs, preferably, according to the invention, grooves 30 are used having transverse section shown in FIG. 3. The dissymmetry of the flank 31 and 32 and the possible overhang of the flank 32 allows the heavy particles to be selected and removed from the action of the lateral drive of the light fraction and all turbulence. Each groove has a uniform depth over a certain length and then this depth decreases to zero. Thus even if a relatively large transverse slope is given to the top, a prejudicial drive of the heavy particles by the light fraction is avoided.

Figure 6:
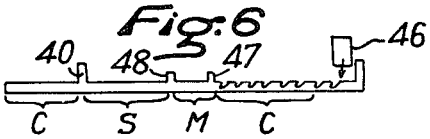
FIG. 6 is a transverse view of the side of the top of FIG. 4.

In order to ensure a regular output rate of sprinkling water, the ramp 33, with coupling, is connected to the hydrostatic column 35 terminating in the overlfow 36. The top is completed by a conventional feed box 37 and receiving hoppers 38. However, instead of arranging the receiving hoppers for sterile light particles, mixtures, and heavy concentrates exclusively at the end of the diagonal zone of the top where the complete separation can be in conventional tables, use is made of the accuracy and speed separation of the table which is the object of the present invention to carry out separation on parts of the top situated on either side of the diagonal zone and on similar surfaces or even further reduced surfaces or to carry a separation along lines a little shorter than that of the diagonal zone. To this effect, the top is divided into three zones I, II, III, bounded by the strips 39 and 40. These zones are fed respectively by the feed boxes 41, 42 and 43 and by the sprinkling ramps 44, 45 and 46. Thus the strip 39 bounds the sterile light particles of the zone I and heavy concentrates of the zone II, the strip 40 bounding the heavy concentrates of the zone I and the sterile light particles of the zone III. The receiving hoppers corresponding to the sterile particles, mixtures and concentrates have been referenced by S M and C respectively. The remainder of the concentrates is held in zone III by the strip 47 and that of the mixtures by the strip 48, the heights of these strips being visible in FIG. 6.

Figure 9:
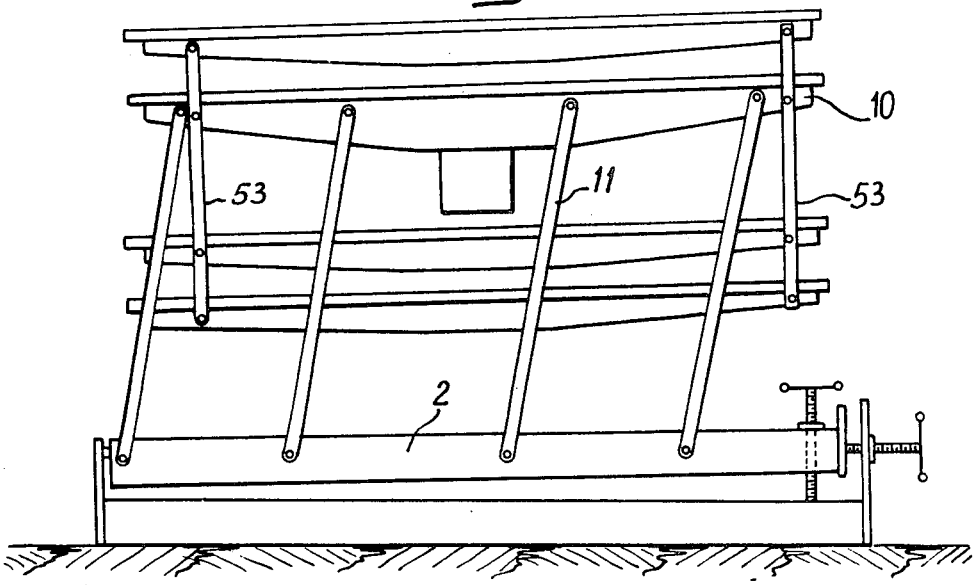
FIG. 9 is a variant of the table comprising several top.

The output rate of the table can still be increased by associating with the top 10, FIG. 9, supported directly by spring blades 11 fixed to the chassis with an adjustable angle 2, a second top 50, 51 and 52 for example connected rigidly together by mounting 53.

Figure 7:
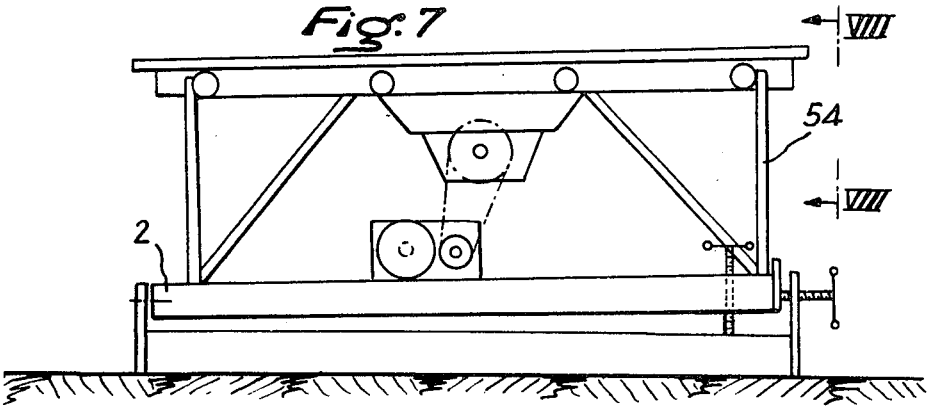
FIG. 7 is a diagrammatic view of the chassis supporting the top.
Figure 8:
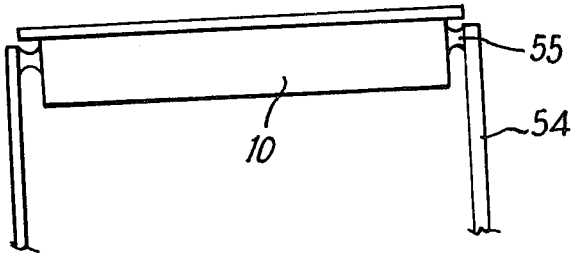
FIG. 8 is a view of the side of the chassis shown in FIG. 7.

The links between the chassis 2 and top 10 provided by the spring blades 11 which a wood such as ash or any other appropriate material whose inclination is adjustable to allow a rapid return operating movement caused by the unbalanced box to be assured. Alternatively, a rigid chassis 54 such as that shown in FIG. 7 and 8 can also be provided. In this case, the top 10 can be connected to the rigid chassis 54 made integral with the chassis having an adjustable inclination 2, by means of elastic supports 55, these supports being able to be rubber masses or springs. Given that the adjusting means allow the trajectories of the particles to be varied by variations in the vibratory movement of the top, these rubber masses or springs are chosen to work with a shearing movement during the compression and drive. The rapid return of the top depends exclusively on the unbalanced box 10 and the unbalancing weights 19 and 20 displaced by the radially or angularly relative to each other.

Additionally, even in the case of a relatively large inclination of the top, there exists a certain tendency for the edge of the table to retain pulp, this retention coming from the surface tension of the pulp at the periphery. This retention creates an incipient mixing of the products. In order to alleviate this disadvantage, the upper ridges 60 of the plate can be rounded or a metal sheet 56 having its upper part cut so as to leave, in relief, cross-wires placed against the flank 10. These grills can be replaced by a ribbon ofspongy moss material. The flow can be still further improved by the creation of notches on the vertical wall.

The assembly of these various arrangements allows not only the ouput of the apparatuses to be increased, but also matches different qualities to be treated even in the case of pulps or minerals where the particle size is less than 100 microns and even down to 50 microns.

We claim:

1. In a vibrating table for the gravimetric separation of a pulp of fine particles in suspension in a liquid having an unbalanced weight box with masses, means for angularly adjusting the positions of the masses, a top provided with projections or hollow grooves, the thickness or the depth of channels between the projections or grooves decreasing in the longitudinal direction of the table, an adjustable chassis for the longitudinal and transverse inclination, a link between the chassis and top comprising series of spring blades, said spring blades having an adjustable inclination, and means for adjusting the amplitude and the frequency of movement imparted to the top by the unbalanced weight box, the improvement comprising: said means for angularly adjusting the positions of the masses to vary the amplitude and the frequency of the movement imparted to the top, said top having diagonal zone bordered by two strips, a feed box for the pulp being arranged relative to the transverse direction above the part up-stream of the top of each of the zones bounded by the strips, each strip by its upstream flank guiding light particles or particles which are not separated, each strip in the region of the downstream flank comprising a sprinkling ramp, and each of the zones defined by said strips comprises at least one receiving hopper for heavy particles and a receiving hopper for light particles.

2. A vibrating table as claimed in claim 1 wherein the top is linked to the chassis for inclination and is adjustable by a rigid support integral with the said chassis and by elastic supports between the rigid support and the top, said top is integral with the unbalanced weight box in a region near its center of gravity, and a group motor with a speed varier controlling said box and being mounted on the said inclinable chassis.

3. A vibrating table as claimed in claim 1 wherein the top is integral with an auxiliary rigid chassis on which are arranged. a second top.

4. A vibrating table as claimed in claim 1 for which the zone of the top situated upstream of the assembly of diagonal strips relative to the transverse inclination comprises at least one parallel strip with said grooves of the top for separating the mixed particles and the heavy particles from the light particles, said parallel strip being interrupted at a given distance from the diagonal strip bounding the zone.

5. A vibrating table as claimed in claim 4 including means alleviating perturbing effects of surface tension of said pulp during tipping into receiving hoppers, said means comprising a grill formed on the edge of the top having a rounded form for the lower edges of the top.

* * * * *

UNITED STATES PATENT AND TRADEMARK OFFICE

CERTIFICATE OF CORRECTION

PATENT NO. : 4,073,996

DATED : March 14,1973

INVENTOR(S) : Richard COHEN-ALLORO et al

It is certified that error appears in the above-identified patent and that said Letters Patent are hereby corrected as shown below:

IN THE ABSTRACT:

Line 4 - After "table" delete ","

IN THE SPECIFICATION:

Column 1, line 5 - after "invention" delete ","

line 11 - delete "device" insert-- devices-- line 13 - after "tables" delete "known,"

Column 2, line 23 - after "invention" , delete "as" insert --is--

UNITED STATES PATENT AND TRADEMARK OFFICE

CERTIFICATE OF CORRECTION

PATENT NO. : 4,073,996

DATED : March 14, 1973

INVENTOR(S) : Richard COHEN-ALLORO et al

It is certified that error appears in the above-identified patent and that said Letters Patent are hereby corrected as shown below:

Column 3, line 9 - delete "top" insert -- tops -- line 29 - delete "serve" insert -- serves --

Column 4, line 10 - after "coupling" insert -- 34 -- line 43 - after "which" insert -- can be of --

Column 5, line 2 - delete "ofspongy" insert -- of spongy --

IN THE CLAIMS:

Column 5, line 27 - after "having" insert -- a --

Column 6, line 17 - after "arranged" delete "."

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*